United States Patent [19]

Fushimoto

[11] Patent Number: 4,602,877

[45] Date of Patent: Jul. 29, 1986

[54] ELECTRONIC EQUIPMENT WITH PRINTER UNIT

[75] Inventor: Hideo Fushimoto, Kawasaki, Japan

[73] Assignee: Canon Kabushiki Kaisha, Tokyo, Japan

[21] Appl. No.: 696,858

[22] Filed: Jan. 30, 1985

Related U.S. Application Data

[63] Continuation of Ser. No. 412,812, Aug. 30, 1982, abandoned.

[30] Foreign Application Priority Data

| | | | |
|---|---|---|---|
| Sep. 8, 1981 | [JP] | Japan | 56-140311 |
| Dec. 8, 1981 | [JP] | Japan | 56-196309 |
| Dec. 8, 1981 | [JP] | Japan | 56-196310 |
| Dec. 8, 1981 | [JP] | Japan | 56-196311 |
| Dec. 10, 1981 | [JP] | Japan | 56-197705 |
| Dec. 17, 1981 | [JP] | Japan | 56-202464 |
| Dec. 17, 1981 | [JP] | Japan | 56-202465 |
| Dec. 17, 1981 | [JP] | Japan | 56-202466 |
| Dec. 18, 1981 | [JP] | Japan | 56-203575 |

[51] Int. Cl.[4] ..... B41J 1/46

[52] U.S. Cl. ..... 400/82; 400/145.2; 400/693

[58] Field of Search ..... 400/29, 43, 82, 88, 400/145.2, 146, 605, 680, 683, 684, 685, 693; 101/104, 105, 379, 405, 406, 93.28, 93.29; 401/102

[56] References Cited

U.S. PATENT DOCUMENTS

| | | | |
|---|---|---|---|
| 723,855 | 3/1903 | Frantz | 400/164.4 X |
| 1,377,651 | 5/1921 | Woodruff | 400/88 X |

FOREIGN PATENT DOCUMENTS

| | | | |
|---|---|---|---|
| 2517461 | 10/1976 | Fed. Rep. of Germany | 400/82 |
| 2541996 | 3/1977 | Fed. Rep. of Germany | 400/82 |
| 27464 | 3/1981 | Japan | 400/146 |
| 562690 | 6/1975 | Switzerland | 400/29 |
| 781214 | 8/1957 | United Kingdom | 401/102 |

*Primary Examiner*—Charles A. Pearson

*Attorney, Agent, or Firm*—Fitzpatrick, Cella, Harper & Scinto

[57] ABSTRACT

There is provided electronic equipment with a printer unit capable of printing on a self-contained first print medium and printing on a second print medium disposed on a desk or the like and means for facilitating the use of the equipment.

2 Claims, 38 Drawing Figures

ELECTRONIC EQUIPMENT WITH PRINTER UNIT

This application is a continuation of application Ser. No. 412,812 filed Aug. 30, 1982, now abandoned.

BACKGROUND OF THE INVENTION

1. Field of the Invention

The present invention relates to electronic equipment with a printer unit and, more particularly, to electronic equipment with a printer unit capable of printing on an internal print form held in the equipment and an external print sheet form disposed on a desk or the like.

2. Description of the Prior Art

Electronic equipment with a printer unit such as a desk-top electronic calculator capable of printing on an internal print roll form (hereinafter referred to as a paper roll) and an external print sheet form (hereinafter referred to as a sheet paper) disposed on a desk or the like has been known. A construction of such a prior art electronic equipment is shown in FIGS. 1–4.

FIG. 1 shows an overall construction of the desk-top calculator with the printer unit. The desk-top calculator generally designated by numeral 1 has a keyboard 2 for entering various inputs on a right upper surface. The keyboard 2 accommodates an arithmetic and logic circuit, a power supply and other circuits. A display 3 for displaying input values and results of the arithmetic operations is provided on a surface of a raised portion at a left half of the desk-top calculator 1.

A window 4 is formed at a rear portion of the left half of the desk-top calculator 1 and a paper cutter 5 is obliquely mounted in the window 4. A paper roll 7 is mounted on a paper roll holder 6 which is mounted at a rear end of the desk-top calculator 1. A leading edge of the paper roll 7 is taken into the desk-top calculator 1 from the rear end thereof and guided externally through a space between the window 4 and a blade 5*a* of the paper cutter 5.

A lever 9 for switching the printing between the paper roll 7 (first mode) and the sheet paper 8 (second mode) is mounted on one side of the window 4.

Numeral 10 denotes a power switch, numerals 11*a* and 11*b* denote column spacing identification marks and a row (line) position identification mark, respectively, numeral 8*a* denotes characters printed on the sheet paper 8 and numeral 8*b* denotes print lines.

The desk-top calculator 1 includes a printer unit as shown in FIGS. 2–4.

The printer unit 12 has a hollow type wheel 13. Type belts 14 made of resilient material are mounted on an outer periphery of the type wheel 13. Each of the type belts 14 has types 14*a* circumferentially arranged at a predetermined pitch. Solenoids 15, one solenoid for each type belt 14, are arranged within the type wheel 13. Each of the solenoids 15 has a hammer 16 associated therewith.

As shown in FIG. 4, by manipulating the lever 9 to engage a gear 19 which is integral with the lever 9, with a gear 18 which is mounted on a rotary shaft 17 of the solenoid 15, the orientation of the hammer 16 is switched between a horizontal position (first mode) shown in FIG. 2 and a vertical position (second mode) shown in FIG. 3.

Numeral 20 denotes a platen, numeral 21 denotes an ink roll numeral 22 denotes an insert port for the paper roll 7, and numeral 23 denotes rolls for feeding the paper roll 7.

The type wheel 13 is driven by a pulse motor (not shown) which is controlled by a control circuit accommodated in the desk-top calculator 1 so that a desired type is positioned at the print position.

By manipulating the lever 9, the hammers 16 are switched between the horizontal position and the vertical position so that the printing is effected on the paper roll 7 or the sheet paper 8. However, this construction has the following disadvantage.

When the lever 9 is manipulated to rotate the hammers 16 in the vertical downward direction to print on the sheet paper 8, the print position is not visible when the desk-top calculator 1 is arranged on the sheet paper 8 because the type wheel 13 is mounted to project slightly from an opening formed on the back side of the desk-top calculator 1. Thus, it is difficult to print at the desired print position.

In order to resolve the above problem, the marks 11*a* and 11*b* are arranged on the side of the desk-top calculator 1 at the positions corresponding to the print positions as shown in FIG. 1 to determine by those marks the print positions on the sheet paper 8.

While the print positions can be defined in this manner, a distance between the sheet paper 8 and the type 14*a* cannot be large because a projection distance of the type 14*a* when it is impacted by the hammer 16 is very small. Accordingly, when the printing is effected on the paper roll 7, the type 14*a* is in very close to the sheet paper 8. As a result, the type may contact the desk or the sheet paper 8, or ink may drop thereon and contaminate them, or the type may contact a projected article on the desk and the type wheel may be broken.

Although the desired print position can be attained by using the marks 11*a* and 11*b*, such positioning is effective only when the sheet paper 8 is sufficiently larger than the desk-top calculator 1 and indicia such as ruled lines are marked on the sheet paper 8. Printing at the exact print position on a small document such as a slip is very difficult.

Since the marks 11*a* are also arranged on the side of the desk-top calculator 1 on which the paper roll 7 is mounted, those marks 11*a* are not visible in determining the print position. Therefore, when printing on the sheet paper 8 on the desk, the paper roll 7 is usually removed from the holder 6 and the holder 6 is accommodated in the desk-top calculator 1.

As a result, when the mode is switched from the paper roll print mode to the sheet paper print mode, the paper roll 7 is first removed from the holder 6, the holder 6 is accommodated in the desk-top calculator 1, the lever 9 is manipulated to rotate the hammers 16 to the vertical position, the desk-top calculator 1 is positioned to the desired print position by the marks 11*a* and 11*b* and then the keyboard 2 is manipulated to print the characters. Thus, the operation is very troublesome.

Since the projection distance of the type 14*a* when it is impacted by the hammer 16 is very small, the distance between the sheet paper 8 and the type 14*a* must always be constant in order to attain uniform printing.

If the sheet paper 8 includes a small step or the mount position of the printer unit 12 is slightly deviated, the distance between the type 14*a* and the sheet paper 8 is non-uniform and non-uniform print or broken print will result.

SUMMARY OF THE INVENTION

It is an object of the present invention to provide electronic equipment with a printer unit capable of printing on an internal print form held in the equipment and an external print form disposed on a desk or the like.

It is another object of the present invention to provide electronic equipment with a printer unit which does not contaminate an external article when the printer unit is in a non-operation condition.

It is another object of the present invention to provide electronic equipment with a printer unit which protects the printer unit from external damage or breaking when the printer unit is in a non-operation condition.

It is another object of the present invention to provide electronic equipment with a printer unit which can exactly and readily print a character at a desired position on an external print form disposed on a desk or the like.

It is another object of the present invention to provide an electronic equipment with a printer unit which can readily switch from an internal print form printing mode to an external print form printing mode.

It is a further object of the present invention to provide electronic equipment with a printer unit capable of printing clearly on an external print form.

Other objects of the present invention will be apparent from the detailed description of the present invention.

BRIEF DESCRIPTION OF THE DRAWINGS

FIGS. 1 to 4 show a construction of prior art equipment, in which FIG. 1 shows an overall perspective view, FIGS. 2 and 3 illustrate the printing on a paper roll and the printing on a sheet paper and FIG. 4 shows a relation between a lever and print hammers, FIGS. 5–8 show a first embodiment of the present invention, in which FIG. 5 shows a perspective view with a protection cover being mounted, FIG. 6 shows a perspective view of the protection cover and FIGS. 7 and 8 show partially enlarged sectional views illustrating the printing on the paper roll and the printing on the sheet paper, FIGS. 9–14 show a second embodiment of the present invention, in which FIGS. 9 and 10 show side views of a solenoid rotation mechanism and the printing on the external sheet paper, FIGS. 11 and 12 show the side views of the solenoid rotation mechanism and the printing on the internal paper roll, and FIGS. 13 and 14 show perspective views illustrating the printing on the external sheet paper, and the printing on the internal paper roll, respectively.

FIGS. 15–18 show a third embodiment of the present invention, in which FIG. 15 shows a perspective view illustrating the printing on the internal paper roll, FIG. 16 shows a perspective view illustrating the printing on the external sheet paper and FIGS. 17 and 18 show a perspective view and a plan view, respectively, illustrating the printing over a plurality of lines at a predetermined pitch, FIGS. 19–22 show a fourth embodiment of the present invention, in which FIG. 19 shows a perspective view with a protection cover being mounted, FIG. 20 shows a perspective view illustrating a positioning method of a print position, and FIGS. 21 and 22 show longitudinal sectional views illustrating the printing on the paper roll and the printing on the sheet paper, FIGS. 23–26 show a fifth embodiment of the present invention, in which FIG. 23 shows an overall perspective view, FIG. 24 shows a perspective view for the positioning, and FIGS. 25 and 26 show longitudinal sectional views illustrating a positioning method and the printing, FIGS. 27 and 28 show a sixth embodiment of the present invention, in which FIG. 27 shows a perspective view and FIG. 28 illustrates the positioning, FIGS. 29–31 show a seventh embodiment of the present invention, in which FIGS. 29 and 30 show perspective views viewed from a top and a bottom, respectively, and FIG. 31 shows a longitudinal sectional view, FIGS. 32–34 show an eighth embodiment of the present invention, in which FIG. 32 shows an overall perspective view and FIGS. 33 and 34 illustrate the printing on the internal paper roll and the printing on the external sheet paper, respectively, and FIGS. 35–38 show a ninth embodiment of the present invention, in which FIG. 35 shows a perspective view of a printer unit, FIG. 36 shows a longitudinal sectional view with a desk-top calculator being lifted up, FIG. 37 shows a longitudinal side sectional view illustrating the printing on the external sheet paper and FIG. 38 shows a longitudinal side sectional illustrating a lifted-up condition on a projection.

DETAILED DESCRIPTION OF THE PREFERRED EMBODIMENTS

First to fourth embodiments described below have a main advantage of preventing external contamination of a sheet paper which is a second print medium and damage or breaking of a printer unit when the printer unit is in a non-print condition.

FIGS. 5–8 show a first embodiment of the present invention. The elements the same as those shown in FIGS. 1–4 are designated by the same numerals and the explanation thereof is omitted here.

Figure 5:
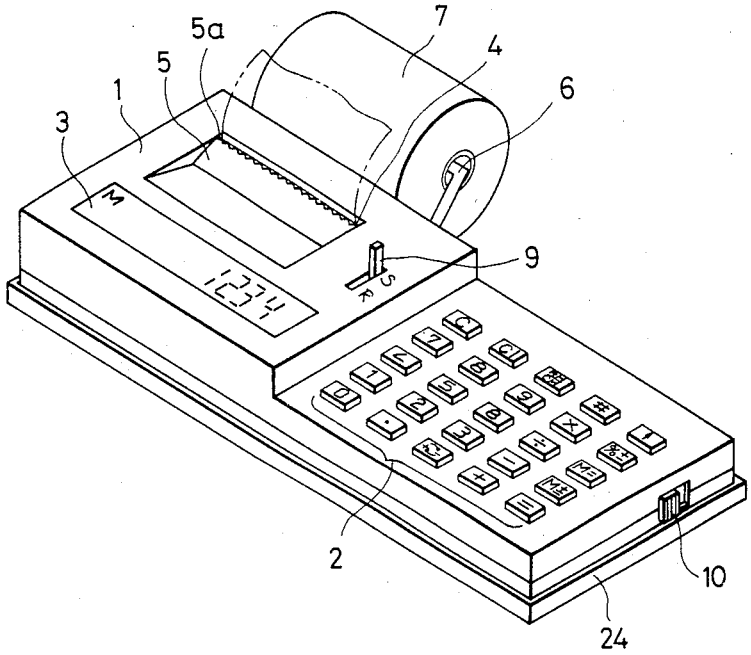
Figure 6:
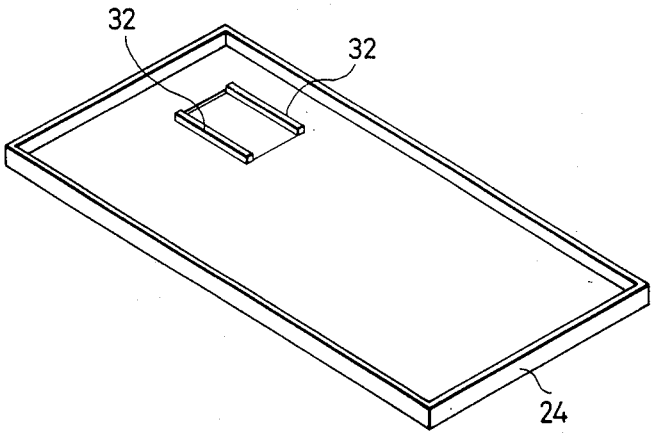

In the present embodiment, as shown in FIG. 5, a protection cover 24 is detachably mounted to a bottom of electronic equipment with a printer unit, which is illustrated as a desk-top calculator. As shown in FIG. 6, the protection cover 24 is a flat casing which covers the entire bottom of the desk-top calculator 1. Thus, when the protection cover 24 is mounted to the bottom of the desk-top calculator 1, it closes a print opening 1*a* formed in the bottom surface of the desk-top calculator 1 to prevent ink from depositing on a desk or a sheet paper on the desk.

One may forget to mount the protection cover 24 during the printing on the paper roll 7. In such a case, if a projected article is present on the desk, the type wheel 13 may be broken, or the desk or the sheet paper 8 may be contaminated.

In the present embodiment, to avoid the above, the printer unit 12 is movably mounted vertical to the main frame of the desk-top calculator 1 and the printer unit 12 is held in the upper position during the printing on the paper roll 7 to prevent the type from contacting to the sheet paper 8.

A detailed construction of the printer unit 12 is now explained.

Figure 7:
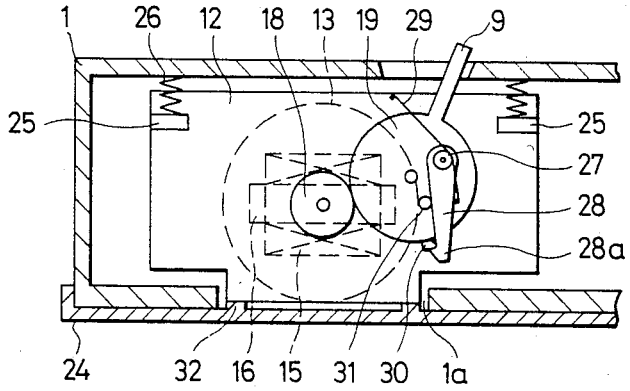
Figure 8:
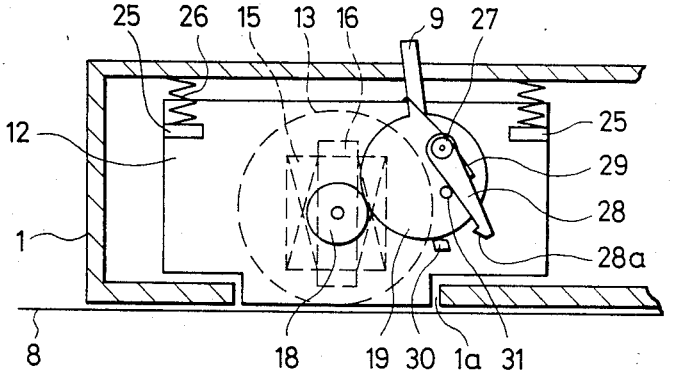

FIGS. 7 and 8 show a lift mechanism of the printer unit 12. Compression springs 26 are resiliently mounted between projections 25 formed on the main frame and an upper plate of the main frame to bias downwardly the entire printer unit 12.

Numeral 28 denotes an engaging lever having an upper end which is pivotably mounted on a shaft 27 and the engaging lever 28 is biased clockwise by a torsion coil spring 29 wound on the axis 27. An engaging end 28*a* at a lower end of the engaging lever 28 is engageable with a stopper 30 mounted on a side wall of the printer unit 12 to restrict the downward movement of the printer unit 12.

A release pin 31 is mounted at an eccentric position on a side wall of the gear 19 of the lever 9. The eccentric pin 31 is mounted at such a position that it does not push the engaging lever 28 when the lever 9 is set to the paper roll print position (first mode).

Two ribs 32 are formed on the protection cover 24 at the positions corresponding to the print opening 1*a* formed in the bottom surface of the main body 1. They serve to push up the printer unit 12 when the protection cover 24 is mounted to the main body 1.

When the lever 9 is switched to the paper roll print position or the first mode and the protection cover 24 is mounted, the engaging end 28*a* of the engaging lever 28 engages the stopper 30. When the protection cover 24 is detached, the downward movement of the printer unit 12 is restricted so that a sufficient clearance is left between the type 14*a* of the type wheel 13 and the bottom surface of the main body of the desk-top calculator 1. Accordingly, the desk or the sheet paper 8 is not contaminated.

Figure 4:
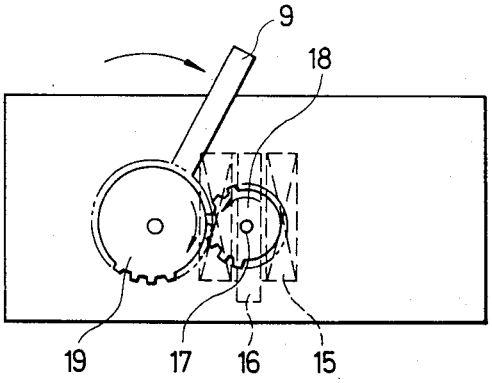

On the other hand, when the lever 9 is switched to the sheet paper print position or the second mode as shown in FIG. 8 to print on the sheet paper 8, the gear 19 integral with the lever 9 is rotated counterclockwise as shown in FIG. 4 and the solenoid 15 is rotated through the gear 18 to bring the hammers 16 to the vertical position.

The pin 31 pushes the engaging lever 28 so that the engaging lever 28 is rotated counterclockwise around the shaft 27 and the engaging end 28*a* is disconnected from the stopper 30. Thus, the printer unit 12 descends by the action of the compression spring 26 to move the type wheel 13 toward the sheet paper 8 and set the type wheel in a printable position. Accordingly, with the protection cover 24 being detached, printing on the sheet paper 8 can be effected.

On the other hand, when it is desired to print again on the paper roll 7, the lever 9 is switched to the paper roll print position or the first mode and the protection cover 24 is mounted to the bottom of the main body. Since the engaging lever 28 is at a position engageable with the stopper 30, when the printer unit 12 is lifted up by the ribs 32, the stopper 30 rides over the engaging end 28*a* to engage the engaging end 28*a*. Accordingly, as described above, the print unit 12 does not descend when the protection cover 24 is detached. Thus, the contamination of the desk even if one forgets to mount the protection cover is prevented and the type wheel is not broken or damaged.

In the illustrated embodiment, the printer unit 12 is always biased downward by the compression spring 26. Alternatively, a tension spring may be used in place of the compression spring 26. In this case, the positions of the engaging end 28*a* of the engaging lever 28 and the stopper 30 are reversed so that the printer unit 12 is normally held in the paper roll print position.

In accordance with the present embodiment, since the protection cover is provided and the printer unit is lifted up and down in linked relation to the lever, the contamination of the desk or the sheet paper by the ink and the damage of the type wheel by the projected article on the desk when the main body is mounted on the desk in the paper roll print mode are prevented. This is true even when one forgets to mount the protection cover.

Figure 9:
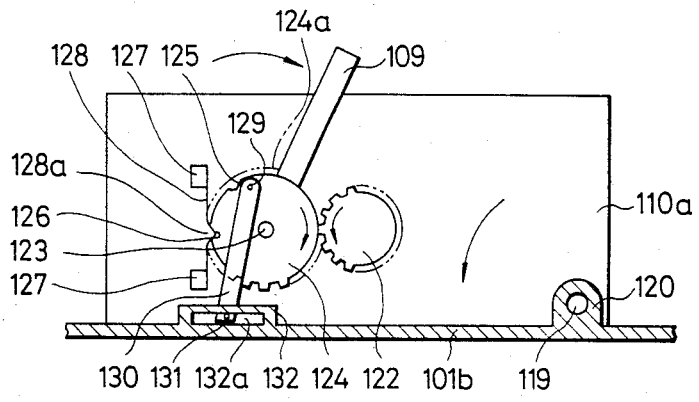

FIGS. 9–14 show a second embodiment of the present invention. In the present embodiment, as shown in FIG. 9 a bracket 120 is pivotably mounted on a shaft 119 at a lower end of a front-half of a casing 110*a* of a printer unit of electronic equipment with the printer unit, which is illustrated as a desk-top calculator. A lower end surface of the bracket 120 is flush with a lower end surface of the casing 110*a*. The casing 110*a* is pivotable around the shaft 119 by a rotation mechanism which will be described hereinafter.

A gear 122 is fixed to one end of a shaft 121 to which a solenoid 113 accommodated in a type wheel 111 is fixed.

A partially toothed gear 124 is rotatably mounted on a shaft 123 fixed to the casing 110*a*, and is adjacent to the gear 122 to engage with the gear 122. Two notches 125 and 126 are formed at a predetermined angular spacing in a non-tooth area 124*a* of the partially toothed gear 124. In the vicinity of the partially toothed gear 124, a stopper 128 made of a leaf spring is mounted to span across support members 127 fixed to the inner wall of the casing 110*a*. A projection 128*a* which is resiliently fitted into the notches 125 and 126 is formed on the leaf spring stopper 128 at a position facing the partially toothed gear 124.

The lever 109 has a lower end fixed to the partially toothed gear 124.

An upper end of a link lever 130 is rotatably mounted, through a pin 129, to an outer periphery of the partially toothed gear 124 in the vicinity of the notch 125. A pin 131 is mounted at a lower end of the link lever 130 and it is slidably fitted into a space 132*a* in a flat U-shaped frame 132 formed on a bottom plate 101*b* of the casing 110*a*. Accordingly, in FIG. 9, when the lever 109 is rotated clock-wise to allow the lower notch 126 to engage the projection 128*a* of the stopper 128, the partially toothed gear 124 is temporarily fixed at that position.

Figure 10:
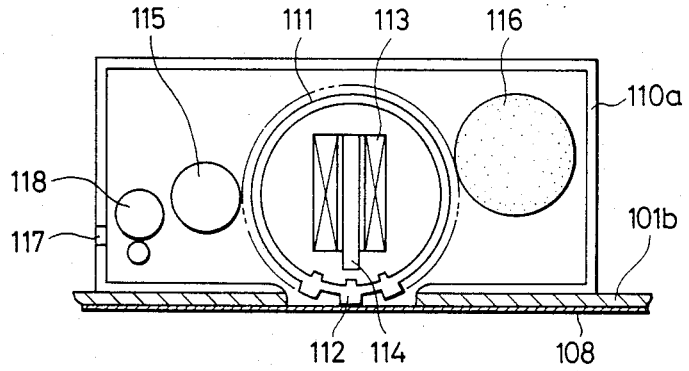

When the partially toothed gear 124 is rotated clockwise in FIG. 9, the gear 122 which rotates a solenoid 113 is rotated counterclockwise by 90 degrees to bring a hammer 114 to a vertically downward position (second mode) as shown in FIG. 10. The type wheel 111 is then rotated by a signal from a control circuit (not shown) to position a type 112 to be printed to a position vertically under the hammer 114, and the solenoid 113 is energized to advance the hammer 114 so that a character is printed on the sheet paper 108 on the desk.

The link lever 130 is pulled up as shown in FIG. 9. However, since the vertical movement of the link lever 130 is restricted by the frame 132, the pin 131 merely moves laterally in the space 132*a* and the operation of the desk-top calculator is not affected.

Figure 11:
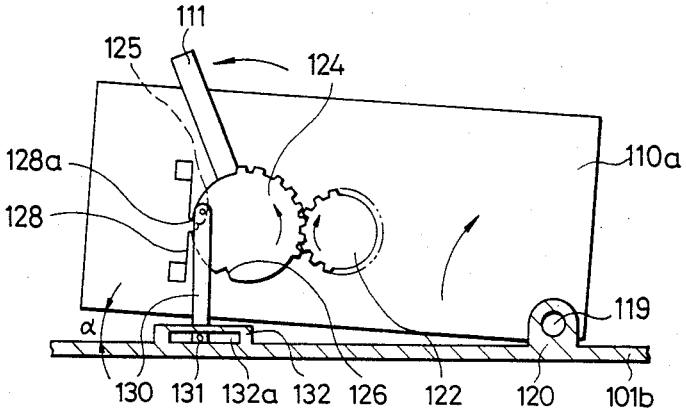

On the other hand, when the lever 109 is rotated counterclockwise as shown in FIG. 11, the partially toothed gear 124 integral therewith is also rotated counterclockwise and the upper notch 125 is fitted to the projection 128*a* of the stopper 128. The partially toothed gear 124 is, therefore, temporarily fixed to that position.

Figure 12:
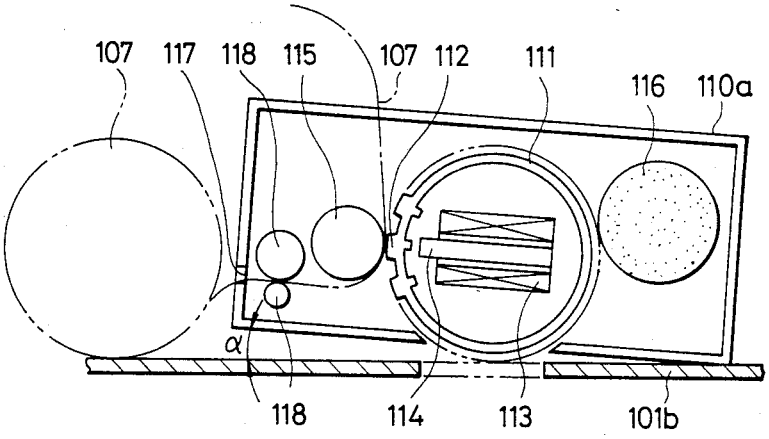

The gear 122 which rotates the solenoid 113 is rotated clockwise to rotate the solenoid 113 clockwise by 90 degrees as shown in FIG. 12 and to bring the hammer 114 in the horizontal position (first mode). Thus, the printing on the paper roll 107 can be effected.

The link lever 130 is descended, but since the pin 131 is restricted by the frame 132, it can move only in the space 132*a*. When the link lever 130 assumes the vertical position as shown in FIG. 11, the pin 131 cannot move in the space 132*a*. As a result, the casing 110*a* of the printer unit 110 is rotated clockwise in FIG. 11 around a shaft 119 on which a leg 120 is pivotably mounted so that a space between the type wheel 111 and the bottom plate 101*b* of the desk-top calculator is expanded. Accordingly, when the hammer 114 which is now in the horizontal position is driven to print the character on the paper roll 107, the type 112 of the type wheel 111 does not contact to the sheet paper 108 on the desk because the distance therebetween is large. Thus, the sheet paper 108 is not contaminated.

Figure 13:
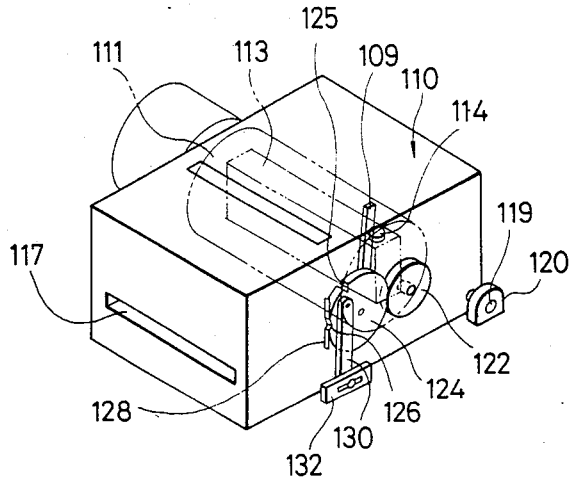
Figure 14:
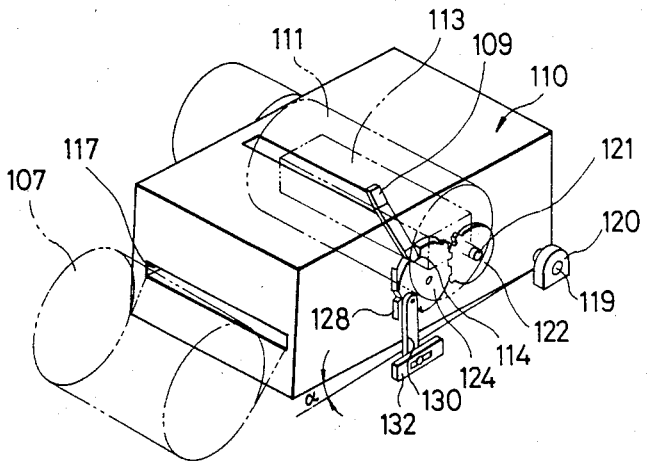

FIG. 13 shows a perspective view of the printer unit in the position for printing on the sheet paper 108 and FIG. 14 shows a perspective view of the printer unit in the position for the printing on the paper roll 107.

In accordance with the present embodiment, electronic equipment with the printer unit capable of printing selectively on the paper roll and the sheet paper by manipulating the lever has the mechanism for rotating the printer unit away from the desk in the paper roll print mode by the link lever which is linked to the switch or lever. Accordingly, the contamination of the sheet paper on the desk by the type wheel in the paper roll print mode and damage or breaking of the type wheel by the contact of the type wheel to the projected article on the desk are prevented.

Figure 1:
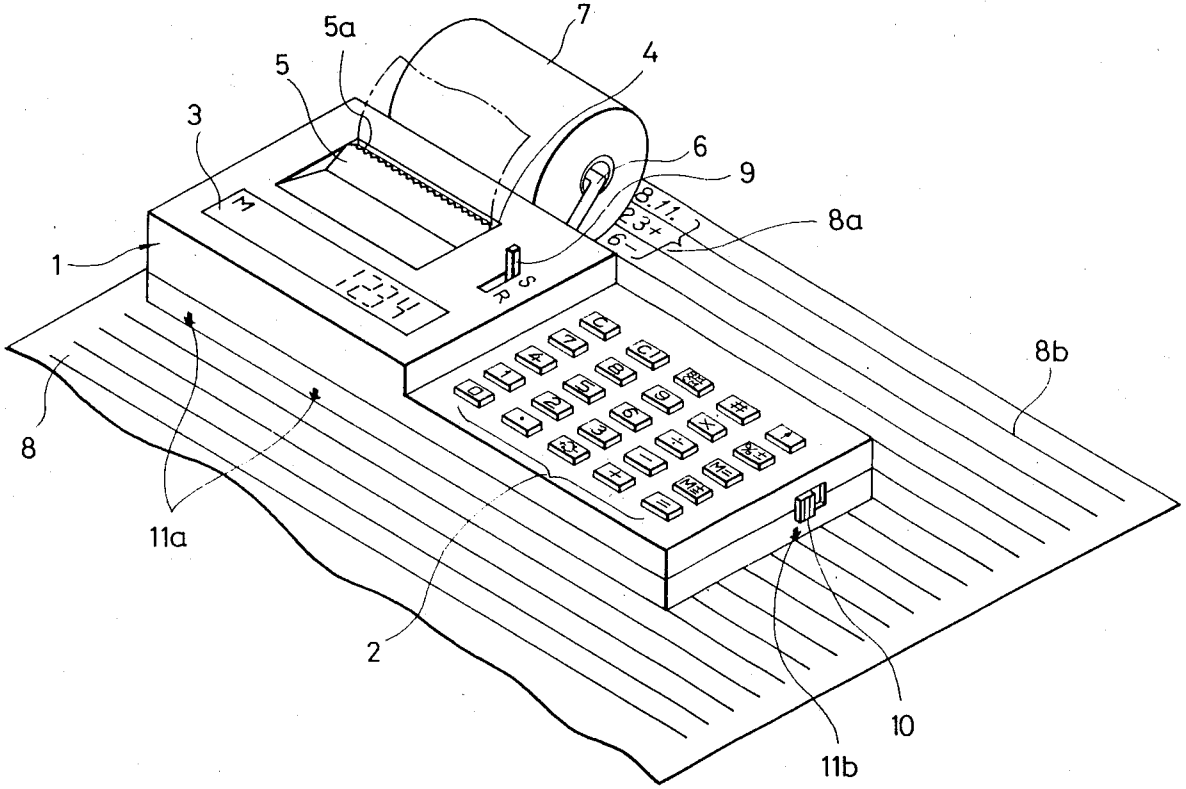
Figure 2:
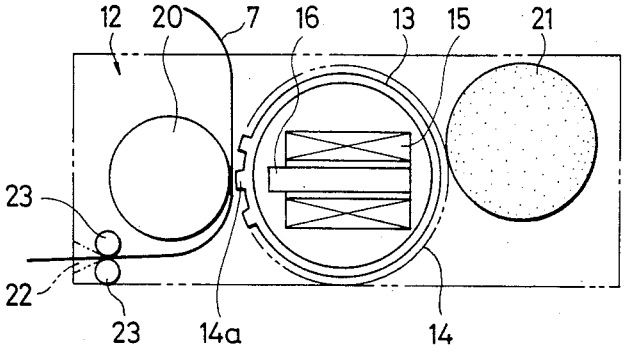
Figure 3:
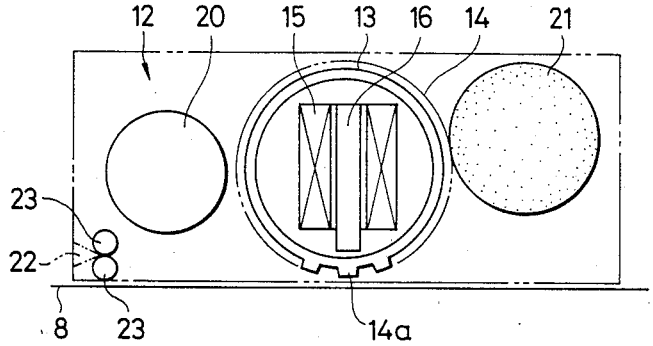

FIGS. 15–18 show a third embodiment of the present invention which embodiment relates to a desk-top calculator having a printer unit 12 similar to that shown in FIGS. 2–4.

Figure 15:
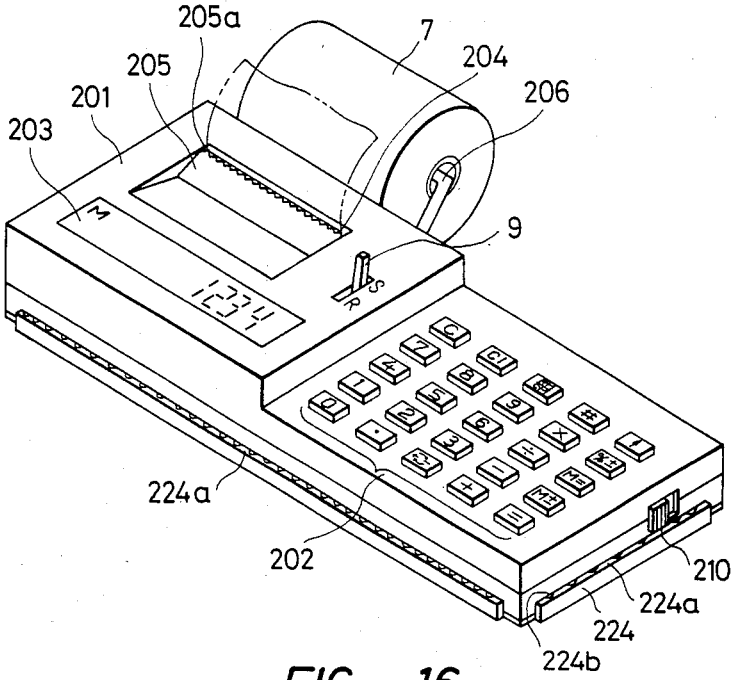

In FIG. 15, numeral 224 denotes a protection cover which is used as a positioning member. The protection cover 224 is generally flat and has rising edges 224*a* of a predetermined height formed on an outer periphery. It can be detachably mounted on a bottom of a main body of the desk-top calculator 201 by utilizing the rising edges 224*a*. Corners of the rising edges 224*a* are not continuous but the rising edges 224*a* of adjacent sides are discontinuous. Grooves 224*b* of different pitches are vertically formed on the outer surfaces of the rising edges 224*a*. Thus, the rising edge 224*a* on one side has the grooves 224*b* of different pitch than those of the rising edges 224*a* on other sides. The pitches of the grooves 224*b* correspond to pitches of ruled lines of desired sheet paper 8, for example, 6 mm or 8 mm, or a desired print line pitch. Thus, when a rectangular protection cover 224 is used, the grooves 224*b* of four different pitches can be formed on the rising edges 224*a*.

Figure 16:
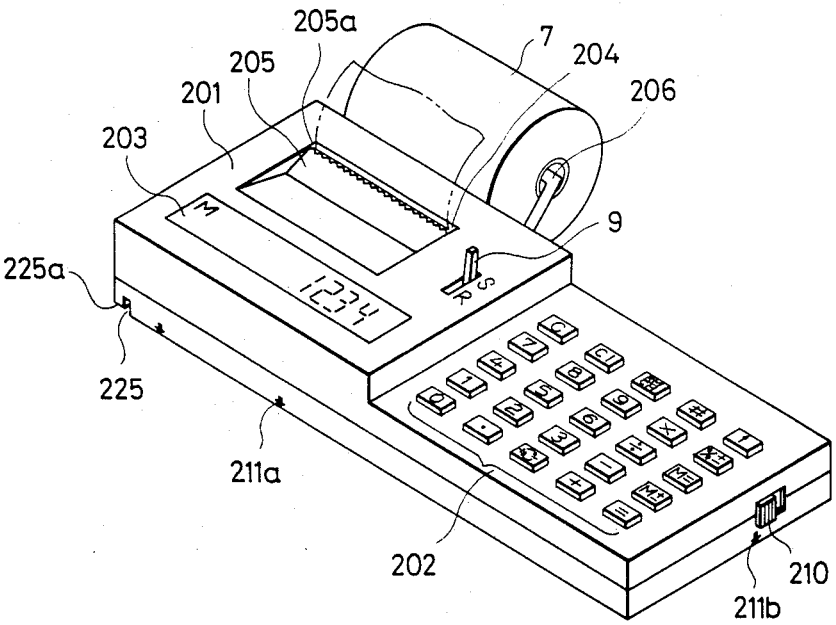
Figure 17:
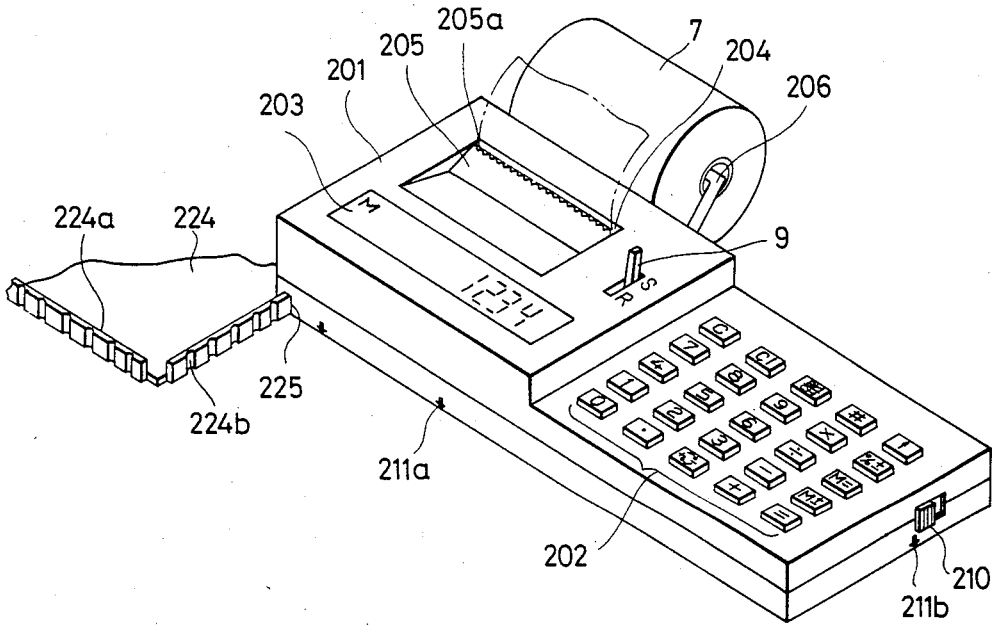
Figure 18:
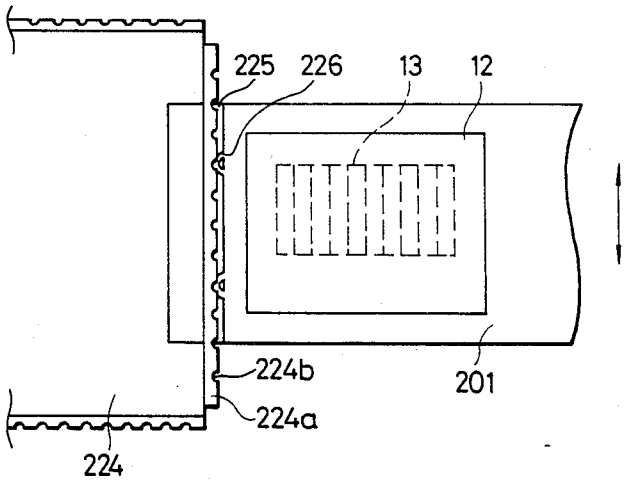
Figure 19:
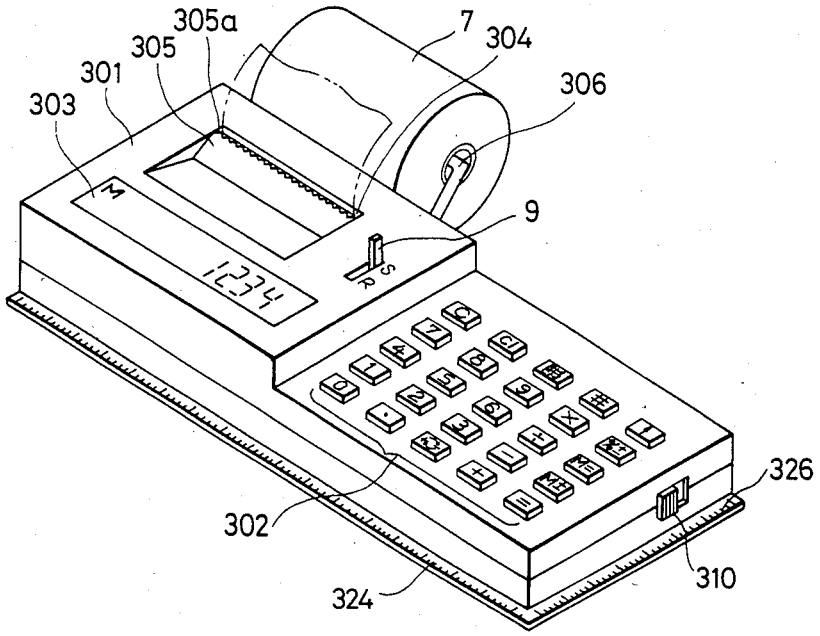

As shown in FIG. 16, a guide slot 225 extends longitudinally of the main body of the desk-top calculator 201 along a side edge thereof. The guide slot 225 is connected to a notch 225*a* formed along the bottom edge of the desk-top calculator 201. A distance between the lower end surface of the notch 225*a* and the bottom surface of the desk-top calculator 201 is substantially equal to the thickness of the protection cover 224. At least one resiliently deformable engaging member 226 is arranged in the guide slot 225.

A method for operating the present embodiment is now explained.

When the printing is to be effected on the paper roll 7, the protection cover 224 is mounted to the bottom surface of the desk-top calculator 201 and the lever 9 is switched to the first mode to bring the hammer 16 to the horizontal position. Since the bottom surface of the desk-top calculator 201 is completely covered by the protection cover 224, the print opening is closed. Thus, when the printing on the paper roll 7 is effected while the desk-top calculator 201 is placed on the sheet paper 8 disposed on the desk, the desk or the sheet paper 8 is not contaminated by the ink and the type wheel 13 is not damaged by the projected article on the desk.

On the other hand, when the printing on the sheet paper 8 disposed on the desk is to be effected, the protection cover 224 is detached as shown in FIG. 16 and the desk-top calculator 201 is positioned by utilizing the positioning marks 211*a* and 211*b*. When the printing is to be made over a number of lines, the rising edge 224*a* of the protection cover 224 is fitted into the guide slot 225 formed in the side edge of the desk-top calculator 201. An appropriate one of the pitches of the grooves 224*b* formed on the outer surfaces of the rising edges 224*a* should be selected. After the rising edge 224*a* having the grooves 224*b* of the desired pitch has been selected, it is fitted into the guide slot 225 and a print position on a first line is determined when the engaging member 226 engages one of the grooves 224*b*. After the printing of the first line, the desk-top calculator 201 is moved upward or downward while the protection cover 224 is fixed by one arm of an operator. Thus, the engaging member 226 is resiliently deformed and engages the next groove 224*b*. The engagement position can be positively determined by manual feeling of the operator. After the one-line shift in this manner, the next line is printed.

In accordance with the present embodiment, the desk and the sheet paper 8 on the desk are not contaminated and the printing over a plurality of lines can be completed in a short time because the positioning is rapidly and exactly effected.

While the desk-top calculator 201 is moved back and forth by utilizing the rising edge 224*a* of the protection cover 224 in the illustrated embodiment, the guide slot may be formed laterally to guide the desk-top calculator 201 laterally at the selected pitch.

While the protection cover is used as the positioning means in the illustrated embodiment, a plurality of positioning members having an L-shaped cross section may be prepared and grooves of predetermined pitches may be formed on the vertical legs thereof.

In accordance with the present embodiment, the positioning member having the L-shaped cross section and the grooves of predetermined pitches vertically formed on the sides thereof is indexed in the guide slot of the desk-top calculator. Thus, by moving the desk-top calculator by one pitch, at a time, of the grooves of the positioning member, the desk-top calculator can be very rapidly and exactly positioned without troublesome positioning steps. Accordingly, the effeciency of the print operation is substantially improved.

In the paper roll print mode (first mode), the positioning member is mounted to cover the bottom surface of the desk-top calculator including the print opening thereof. Accordingly, the type wheel is not externally damaged and it does not contaminate the external material.

FIGS. 19–22 show a fourth embodiment of the present invention in which the the same as those shown in FIGS. 1–4 are designated by the same numerals and the explanation thereof is omitted here.

In FIGS. 19–22, numeral 324 denotes a protection cover which serves as a positioning member. It is a flat frame having rising edges 324*a* along a periphery thereof which is resiliently and detachably mounted to a bottom surface of a desk-top calculator 301. A positioning scale 326 is formed on the entire periphery of the protection cover 324.

Figure 21:
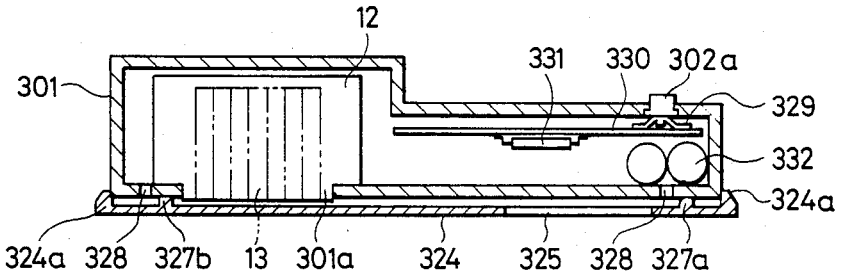
Figure 22:
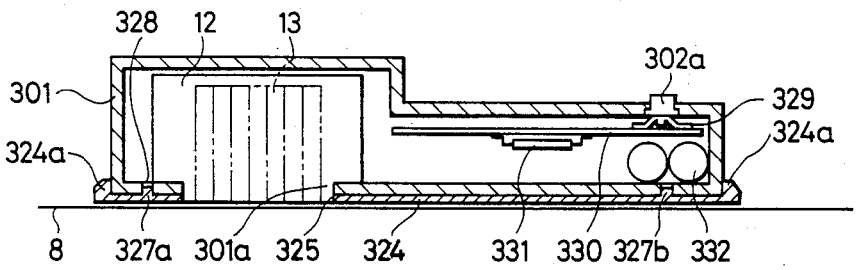

An opening 301*a* is formed in the bottom of the desk-top calculator 301 at a position facing toward the type wheel 13 and an opening 325 is formed in the protection cover 324 at a position facing toward the opening 325. Projecting pins 327*a* and 327*b* are formed at predetermined positions or the upper surface of the protection cover 324 a distance between the pin 327*a* and the closed rising edge 324*a* is not equal to a distance between the pin 327*b* and the closest rising edge 324*a*. Apertures 328 are formed in the bottom of the desk-top 301 at positions facing toward the pins 327*a* and 327*b* so that the pins 327*a* and 327*b* are fitted therein. In FIGS. 21 and 22, numeral 302*a* denotes a key, numeral 329 denotes a key contact, numeral 330 denotes a printed circuit board on which an electronic part 331 is mounted and numeral 332 denotes a power supply.

A method for operating the present embodiment is now explained.

In the paper roll print mode, the protection cover 24 is oriented such that the opening 325 does not face toward the type wheel 13 and it is mounted to the bottom of the desk-top calculator 301 by utilizing the rising edges 324*a*. Since the pins 327*a* and 327*b* are differently located as described above, they do not fit into the apertures 328 under this condition and the desk-top calculator 301 is held in a lifted position by the height of the pins 327*a* and 327*b*. Since the opening 325 is not located under the type wheel 13, the type wheel 13 does not contact the sheet paper on the desk and does not contact the projecting article on the desk. Accordingly the sheet paper is not contaminated and the type wheel is not damaged.

On the other hand, when the printing is to be made on the sheet paper 8, the protection cover 324 is oriented such that the opening 325 faces toward the type wheel 13 and it is mounted to the bottom of the desk-top calculator 301. Under this condition, the pins 327*a* and 327*b* are completely fitted into the apertures 328 as shown in FIG. 22 so that the desk-top calculator 301 contacts the upper surface of the protection cover 324 and the type wheel 13 is exposed to the print position through the opening 325. Thus, the printing on the sheet paper 8 on the desk can be effected.

In the condition shown in FIG. 22, if the size of the sheet paper 8 is sufficiently larger than the desk-top calculator 1 and ruled lines are drawn on the sheet paper 8, the print position can be readily determined by utilizing the scale 326.

Figure 20:
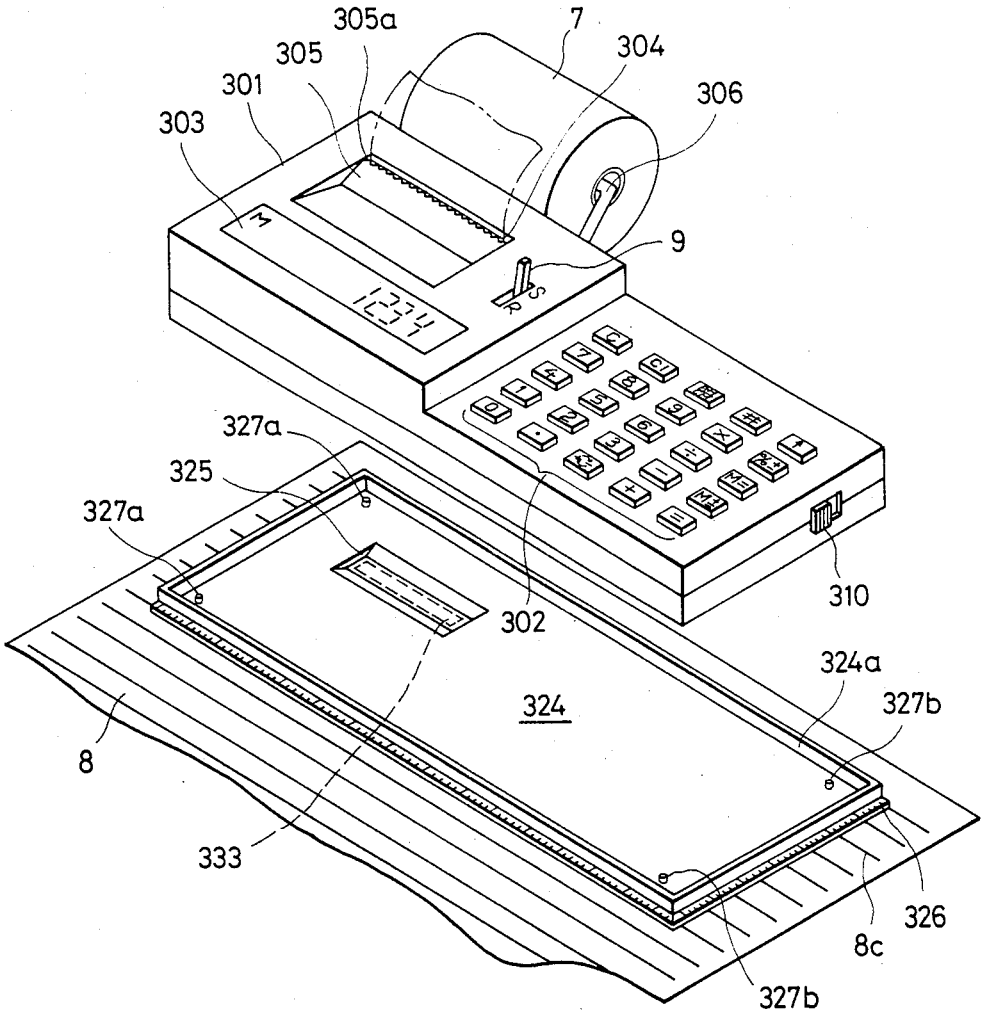
Figure 23:
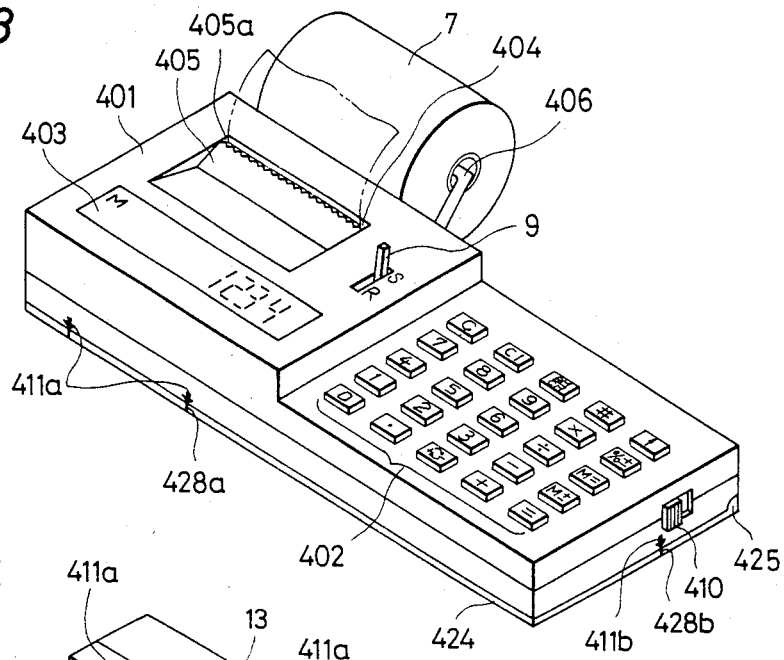

When the size of the sheet paper 8 is small such as a slip and has no ruled line, the opening 325 is positioned to the print position designated by 333 in FIG. 20 and then the desk-top calculator 301 is fitted to the protection cover 324. In this manner, the exact print position can be determined.

In accordance with the present embodiment, the detachable protection cover is mounted to the bottom of the electronic equipment with the printer unit such as the desk-top calculator, the print opening for the sheet paper is formed in the protection cover at the position facing toward the type wheel, the pins are formed on the upper surface of the protection cover such that the pins are selectively fitted into the apertures formed in the bottom of the electronic equipment, and the positioning scale is formed on the periphery of the protection cover. Thus, in the paper roll print mode (first mode), the protection cover is mounted in such an orientation that the opening of the protection cover does not face toward the type wheel to shield the type wheel. Accordingly, the sheet paper is not contaminated and the type wheel is not damaged by the projecting article on the desk. In addition, the exact positioning to the print position on the sheet paper can be attained by utilizing the opening of the protection cover.

Fifth to seventh embodiments of the present invention which will be described hereinafter have a main advantage that the printing can be readily and exactly made at a desired position on the sheet paper disposed on the desk or the like.

FIGS. 23–26 show a fifth embodiment of the present invention. The elements the same as those shown in FIGS. 1–4 are designated by the same numerals and the explanation thereof is omitted here.

In the present embodiment, a positioning plate 424 is pivotably mounted to a lower edge of a bottom of a desk-top calculator 401 by shaft 425.

Figure 24:
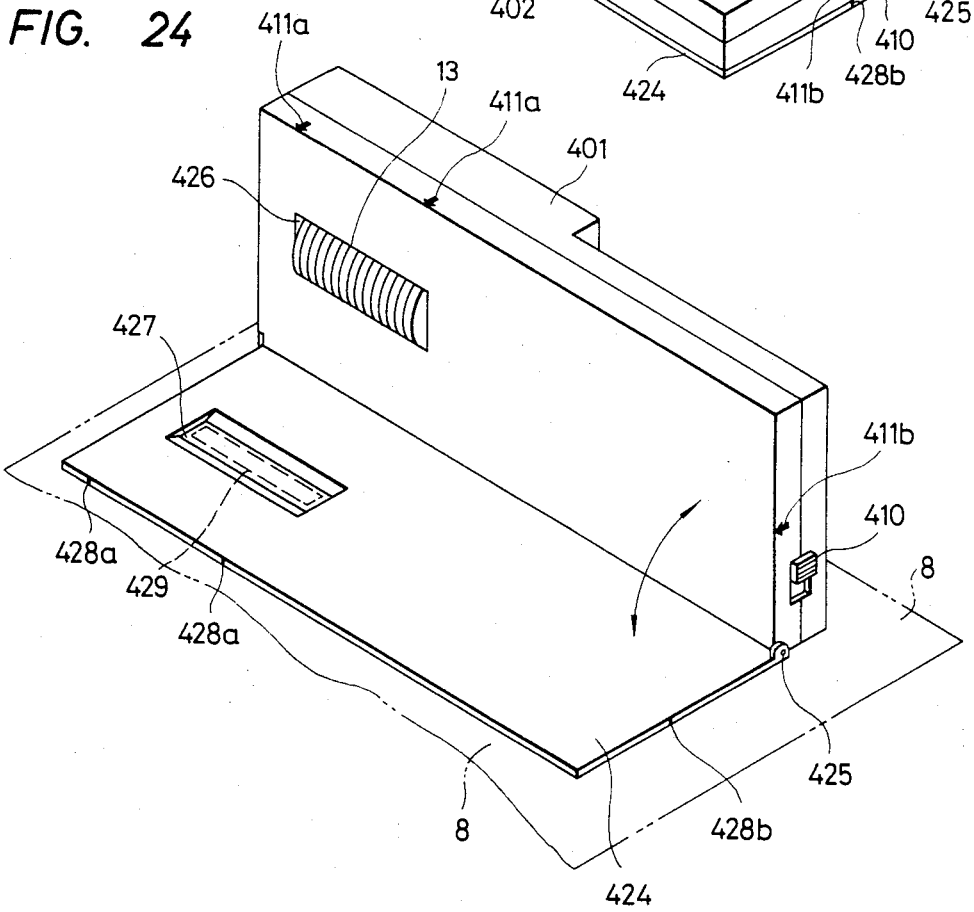

As shown in FIG. 24, the positioning plate 424 has the substantially same area as the bottom of the desk-top calculator 401 and marks 428*a* and 428*b* are formed on side walls thereof at positions facing toward marks 411*a* and 411*b* formed on side walls of the desk-top calculator 401.

It is preferable that the positioning plate 424 has the same area as the bottom of the desk-top calculator 401 although the size is not limited.

An opening 427 is formed in the positioning plate 424 at a position facing toward an opening 426 of the desk-top calculator 401 through which the print wheel 13 extends. The opening 427 has an area which allows the printing of all columns in one line of the type wheel 13.

Figure 25:
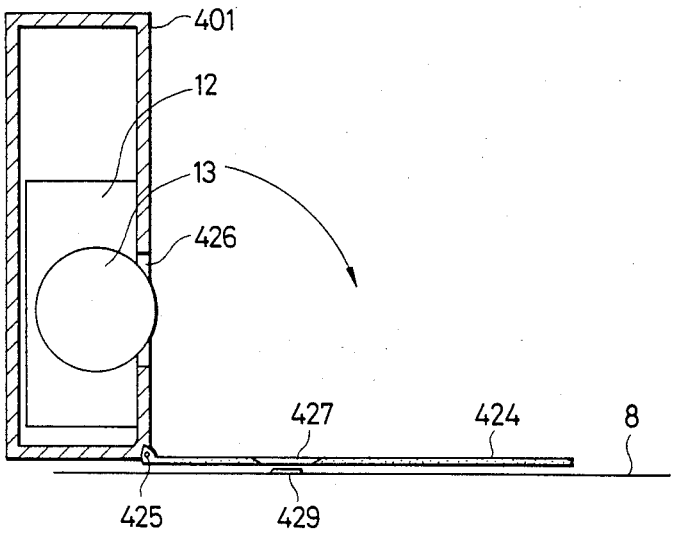
Figure 26:
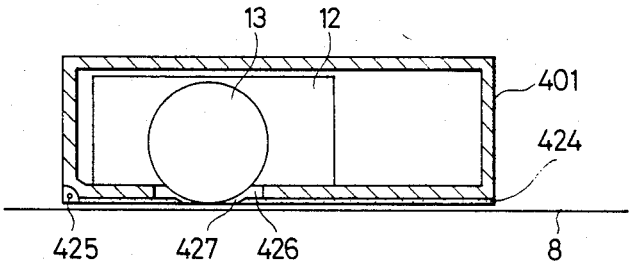

In the print operation, the positioning plate 424 is placed on the sheet paper 8 as shown in FIGS. 24 and 25, the desk-top calculator 401 is brought to a vertical position to the sheet paper 8 and the opening 427 is in the desired print position 429. Then, the desk-top calculator 401 fallen down on the positioning plate 424 and the lever 9 is switched to the sheet paper print position (second mode) to effect printing.

When the positioning plate 424 is mounted in contact with the bottom of the desk-top calculator 401, the projection distance of the type wheel 13 from the bottom of the desk-top calculator 401 should be determined taking the thickness of the positioning plate 424 into consideration so that the printing on the sheet paper 8 is positively made. When rapid positioning to the print position on the sheet paper 8 is desired, the marks 411*a* and 411*b* formed on the side walls of the desk-top calculator 401 and the marks 428*a* and 428*b* formed on the side walls of the positioning plates 424 may be utilized.

The positioning plate 424 may be mounted in contact with the bottom of the desk-top calculator 401 or it may be accommodated in a recess formed in the bottom of the desk-top calculator. Any scale may be formed on the positioning plate 424.

In accordance with the present embodiment, the positioning plate is pivotably mounted to the bottom of the electronic equipment and the positioning opening is formed in the positioning plate. Thus, the print position on the sheet paper disposed on the desk can be exactly determined and the exact and rapid printing at the desired print position can be attained.

Figure 28:
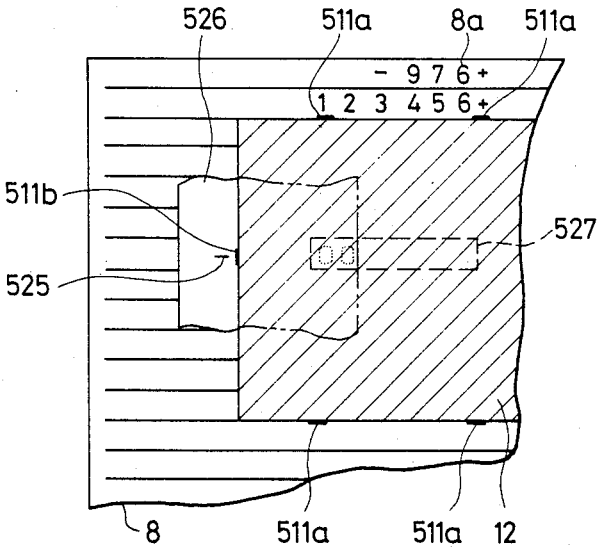
Figure 27:
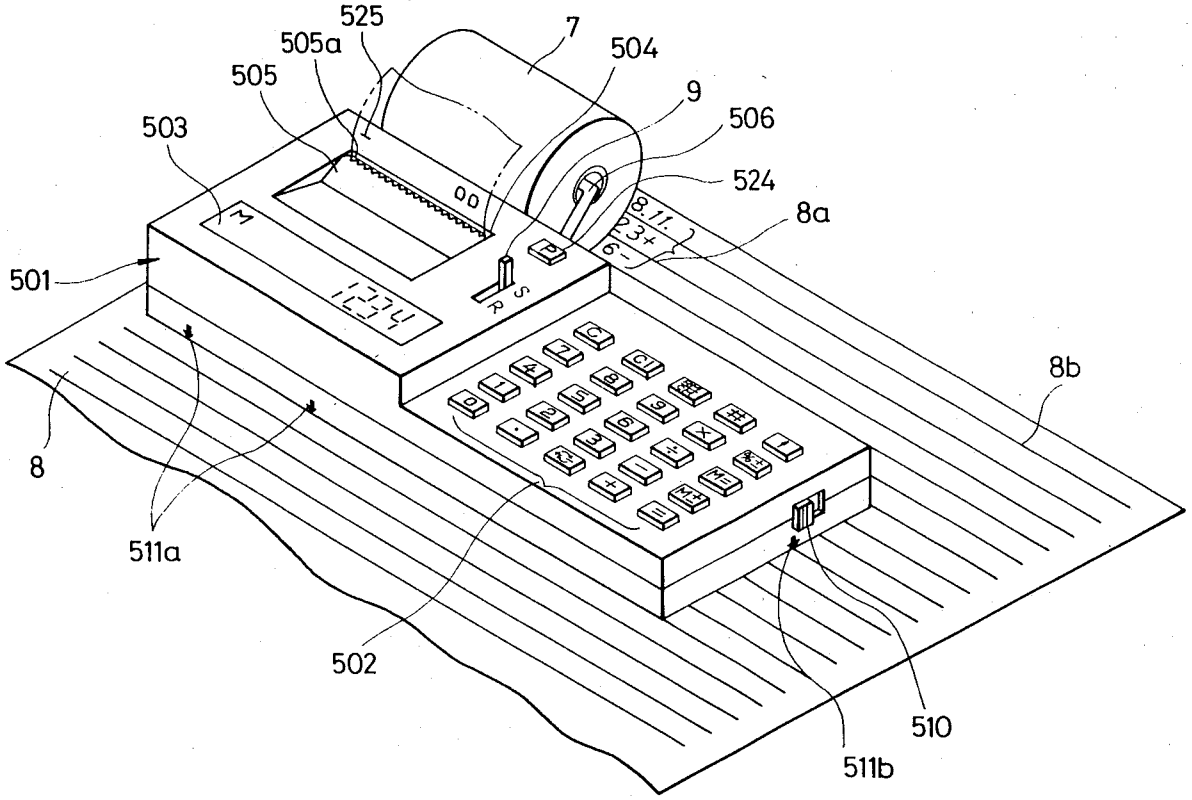

FIGS. 27 and 28 show a sixth embodiment of the present invention, in which the elements the same as to those shown in FIGS. 1–4 are designated by the same numerals and the explanation thereof is omitted here. The sixth embodiment has the printer unit 12 although the print unit is not shown.

In the present embodiment, a print key switch 524 is provided above the lever 9. It is a print key for printing a scale on the paper roll 7 as will be described hereinafter.

In printing the scale in the present embodiment, predetermined scale characters, for example "- 00" are selected and they are printed on the paper roll 7 by depressing the print key 524. After the scale printing, the paper roll 7 is fed by a predetermined distance so that the paper is fed out from a blade 505*a* of a paper cutter 505 by an appropriate amount. The paper is then cut and it is used as a scale.

In the scale characters "- 00", the leftmost "-" is used as an indicia for setting a vertical position to the print position on the sheet paper 8 and the right end "00" are used as an indicia to determine a lateral print position.

When the printing on a predetermined print position on the sheet paper 8 is to be made, the lever 9 is switched to the sheet paper print position (second mode) to bring the hammer 16 of the printer unit 12 to the vertical position.

Then, the scale printing is made as shown in FIG. 28 and the cut paper roll 7 is placed on the sheet paper 8 such that the left "0" of "00" of the scale character 525 is registered to the left end of the desired print position 527 on the sheet paper 8 and the cut paper 526 of the paper roll 7 is inserted between the sheet paper 8 and the desk-top calculator 501 such that the scale character "-" is registered with the mark 511*b* formed on the side wall of the desk-top calculator 501 to indicate the vertical print position.

In this manner, the print position can be determined after the determination of the print position, the cut paper 526 can be readily taken out while the desk-top calculator 501 and the sheet paper 8 are held in place because the cut paper 526 is very thin, and the keyboard 502 is manipulated to print desired characters at the desired print position 527 on the sheet paper 8.

Once the cut paper 526 having the scale characters 525 printed thereon has been prepared, it can be used many times, and if it is lost, it can be prepared by using the paper roll 7.

In the above embodiment, the scale characters "- 00" are used. They are selected from the symbols and the characters normally arranged on the type wheel of a conventional type wheel printer unit. If the type wheel has a space, other symbols may be arranged for use as the scale characters. The number of characters of the scale characters may be appropriately selected in accordance with the size of the desk-top calculator.

In accordance with the present embodiment, in printing the characters at the desired print position by the electronic equipment having the print position marks formed on the side walls of the electronic equipment, the scale characters are printed on the paper roll and the electronic equipment is positioned by utilizing the scale characters and the positioning marks while the paper having the scale characters thereon and cut from the paper roll is inserted between the sheet paper and the electronic equipment. Therefore, no special positioning member is required and the exact and positive printing at the desired print position can be attained.

Figure 29:
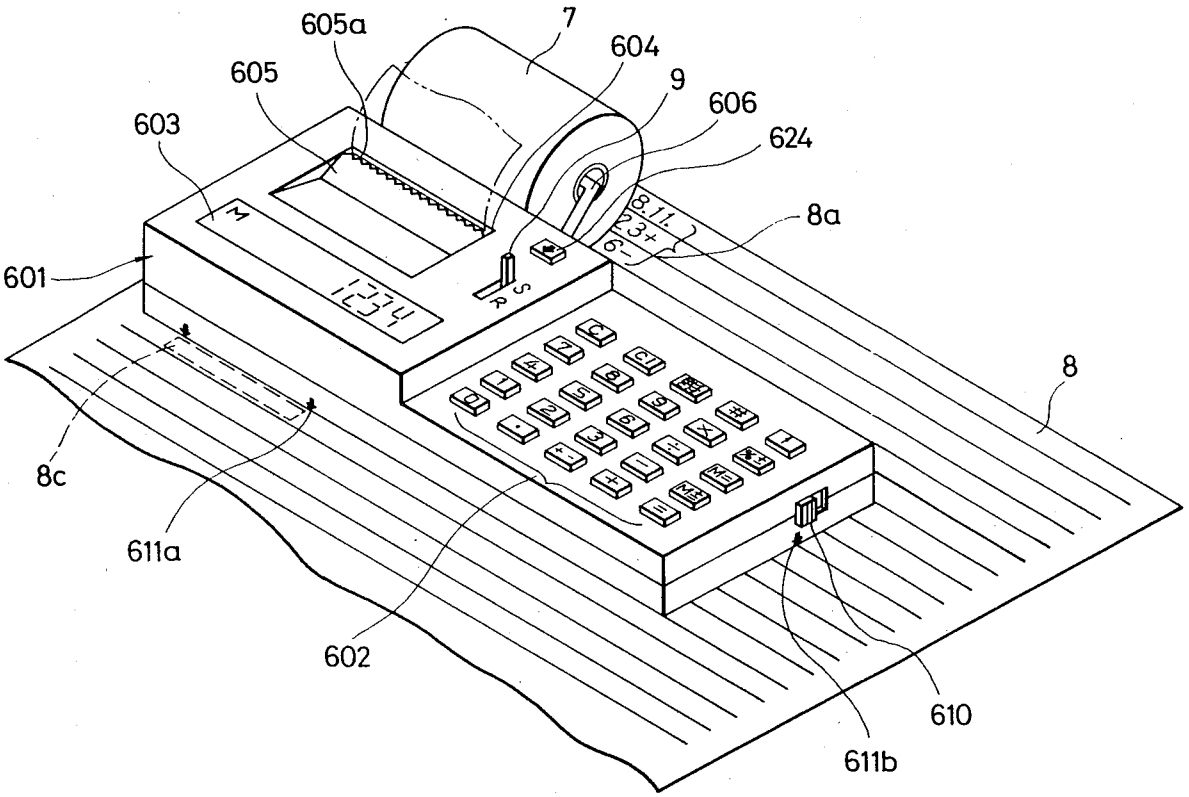
Figure 30:
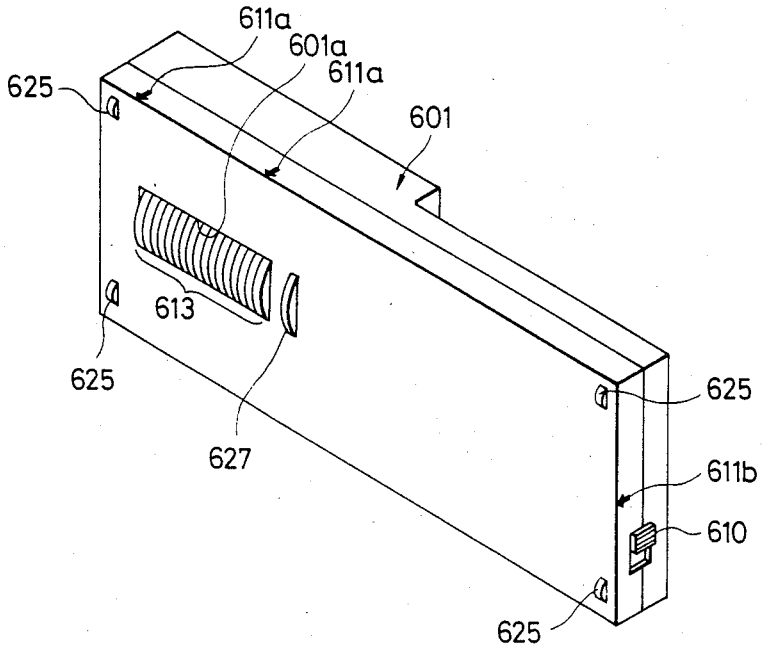
Figure 31:
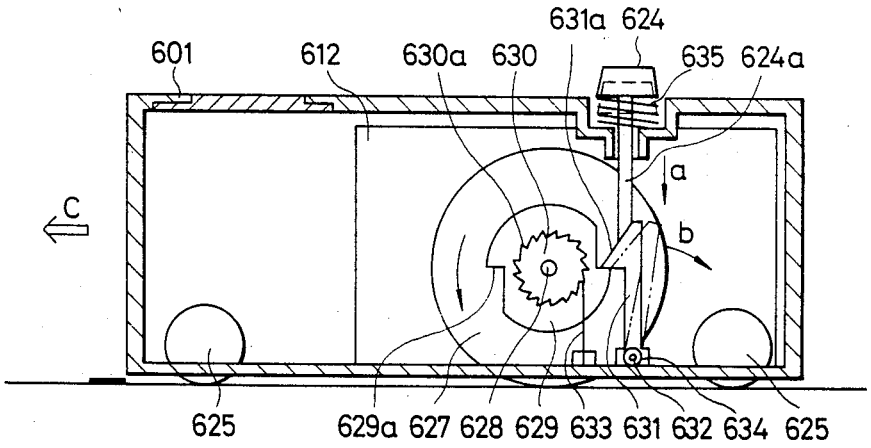

FIGS. 29–31 show a seventh embodiment of the present invention, in which the elements the same as those shown in FIGS. 1–4 are designated by the same numerals and the explanation thereof is omitted here.

In the present embodiment, the lateral positioning of a desk-top calculator 601 to a predetermined print position is effected by marks 611*a* and 611*b* formed on the side walls of the desk-top calculator 601.

A positioning button 624 is provided adjacent to the lever 9 arranged on the upper surface of the left half of the electronic equipment 601.

Rolls 625 are provided at four corners on the back side of the desk-top calculator 601 to allow back and forth movement of the desk-top calculator 601. A rotatable positioning roll 627 which allows the desk-top calculator 601 to be moved forward by a predetermined distance is provided near an opening 601*a* through which the type wheel 613 is extended downward in the sheet paper print mode. The positioning roll 627 is driven under the control of the positioning button 624.

Specific structures of the positioning button 624 and the positioning roll 627 are shown in FIG. 31.

The positioning roll 627 is rotatably mounted on a rotary shaft 628 of the printer unit 612. The positioning roll 627 is mounted to project from the back surface of the desk-top calculator 601 by a predetermined distance. A cam plate 629 is integrally formed with the positioning roll 627 on the outer surface thereof. The cam plate 629 has a notch 629*a* on a periphery thereof to allow the rotation of the positioning roll 627 by a predetermined angle. An anti-reverse rotation ring 630 is provided on the outer surface of the positioning roll 627 to prevent the reverse rotation of the positioning roll 627. Ring 30 rotates with the positioning roll 627.

Numeral 631 denotes an engaging member having a lower end thereof rotatably mounted on a shaft 632 arranged at the lower end of the desk-top calculator 601 and an engaging end 631*a* formed at an upper end which engages the notch 629*a* of the cam plate 629 to prevent the counterclockwise rotation of the positioning roll 627. The engaging end 631 is normally urged in the direction such that the engaging end 631*a* engages the cam plate 629 by an action of a torsion coil spring 634 attached to the shaft 632.

The anti-reverse rotation ring 630 is restricted relative to a ratchet 630*a* by a stopper 633 made of resilient material having a lower end thereof fixed to the lower surface of the desk-top calculator 601.

On the other hand, a support shaft 624*a* of the positioning button 624 is vertically movably fitted in the desk-top calculator 601 and the lowermost end thereof is at a position to contact an oblique surface of the engaging end 631*a* of the engaging member 631. The positioning button 624 is normally biased upward by a spring 635.

The operation of the present embodiment is now explained.

When characters are to be printed on a specific line 8*c* on the sheet paper 8, the lateral positioning of the desk-top calculator 601 is effected by utilizing the mark 611*a* and the upper edge of the print line 8c is registered to the front edge of the desk-top calculator 601.

Then, the positioning button 624 is depressed to rotate the engaging member 631 by the lower end of the support shaft 624a in the direction of an arrow b to a position shown by a chain line in FIG. 31 to disengage the engaging end 631a from the notch 629a of the cam plate 629. Then, the desk-top calculator 601 is slightly moved in the direction of an arrow c shown in FIG. 31 or a forward direction of the desk-top calculator 601. Then the depression of the positioning button 624 is released so that the engaging end 631a is disengaged from the notch 629a and contacts an arcuate surface of the cam plate 629. As the desk-top calculator 601 is further moved in the direction of the arrow c, the positioning roll 627 is rotated and it is stopped at a position where the engaging end 631a engages the next notch 629a. The diameter of the positioning roll 627 and the position of the notch 629a on the cam plate 629 are designed such that the print line 8c is exactly registered to the print position under thiscondition.

In this manner, the lateral positioning is effected by utilizing the marks and the desk-top calculator 601 is then moved forward, and the desk-top calculator 601 can be exactly moved to the print position and the exact printing is effected.

In the present embodiment, the positioning is effected by the roll which is rotatable in the longitudinal direction. Alternatively, a positioning roll which is rotatable in the lateral direction may be used. In this case, the vertical positioning of the sheet paper 8 is effected by the mark 611b and then the desk-top calculator 601 is laterally moved to determine the print position. Any one of the above constructions may be selected depending on a desired print format.

In accordance with the present embodiment, a plurality of rolls which are rotatable either in the longitudinal direction or in the lateral direction as arranged on the back surface of the electronic equipment and at least one of those rolls is externally controlled to rotate only a predetermined amount. Thus, the positioning of the print position on the sheet paper in one of the longitudinal direction and the lateral direction is effected by utilizing the print position marks on the side wall of the equipment and then the electronic equipment is moved by the roll. In this manner, the print position is exactly determined even when the sheet paper has no ruled line or the size of the sheet paper is small.

Figure 32:
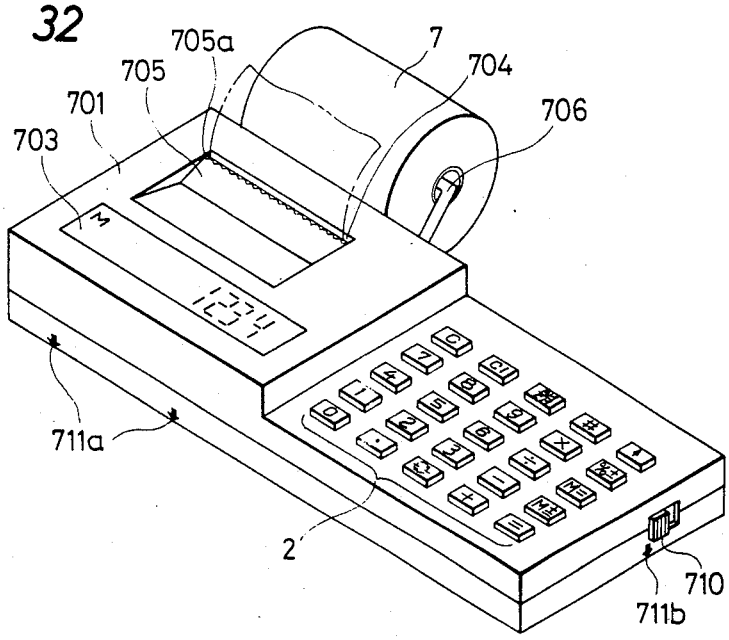
Figure 33:
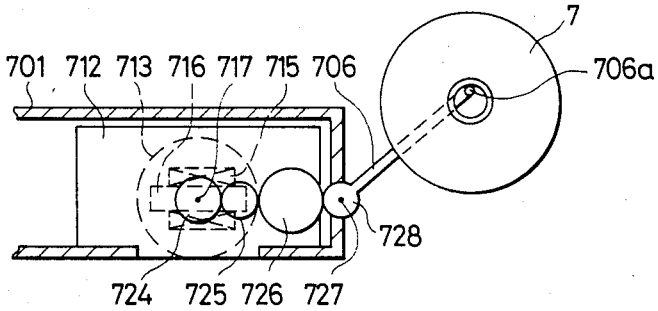
Figure 34:
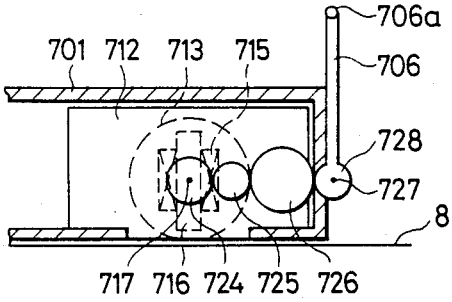
Figure 35:
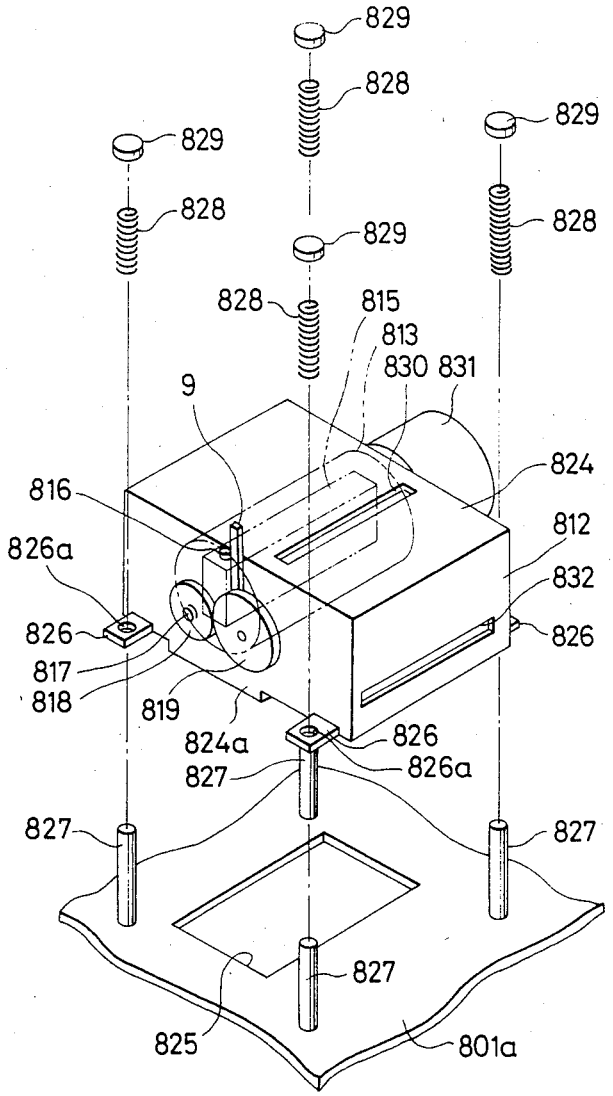

FIGS. 32–34 show an eighth embodiment of the present invention, in which the elements the same as to those shown in FIGS. 1–4 are designated by the same numerals and the explanation thereof is omitted here.

In the present embodiment, the lever 9 is removed as shown in FIG. 32 and a gear 728 is mounted on a shaft 727 of a support to a holder 706. A gear 724 is fixed to a rotary shaft 717 of a solenoid 715 and intermediate gears 725 and 726 are arranged between the gears 724 and 728 to link the rotation of the gear 728 by the pivotal movement of the holder 706 to the rotation of the solenoid 715.

Thus, in the paper roll print mode (first mode), the holder 706 is extended as shown in FIG. 33 so that the hammer 716 is brought to the horizontal position.

When the mode is to be switched to the sheet paper print mode (second mode) after the paper roll print mode, the paper roll 7 is removed from the holder 706 and the holder 706 is rotated to the vertical position as shown in FIG. 34. As a result, the gear 727 is rotated and the rotation thereof is transmitted through the gears 726, 725 and 724 so that the hammer 716 is brought to the vertical position or the print position to the sheet paper 8 (second mode).

When it is desired to print again on the paper roll 7, the reverse operation is carried out.

In accordance with the present embodiment, since the position of the print hammer is switched in linked relation to the storage operation of the holder for the paper roll, the switching between the paper roll print mode and the sheet paper print mode can be very readily effected and no special lever is required. Thus, the operation is very simple and convenient.

FIGS. 35–38 show a ninth embodiment of the present invention, in which the elements the same as those shown in FIGS. 1–4 are designated by the like numerals and the explanation thereof is omitted here.

In the present embodiment, several ears 826 are formed on side walls of a casing 824 of a printer unit 812 and apertures 826a formed in the ears 826 are slidably fitted vertically to support shafts 827, which serve as guide members, formed on a bottom plate 801a of a desk-top calculator 801.

Coil springs 828 are resiliently loaded between the upper surfaces of the ears 826 and stoppers 829 fixed to the top ends of the support shafts 827 to normally bias the printer unit 812 downward.

A step 824a is formed at the lower end of the casing 824 of the printer unit 812. A distance between the lower surface of the step 824a and the type on the type wheel 13 is maintained which allows the type to project when it is impacted by the hammer 16 to print positively the character. The step 824a is extended downward through a print opening 825 formed in the bottom plate 801a of the desk-top calculator 801. Numeral 831 denotes a pulse motor for driving the type wheel 813, numeral 830 denotes an ejection roll for the paper roll and numeral 832 denotes an insertion port for the paper roll.

Figure 36:
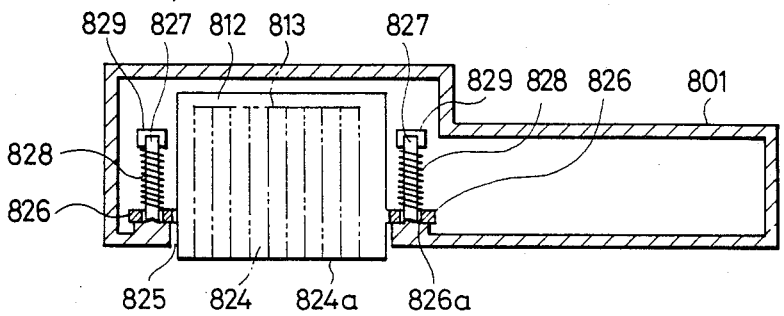
Figure 37:
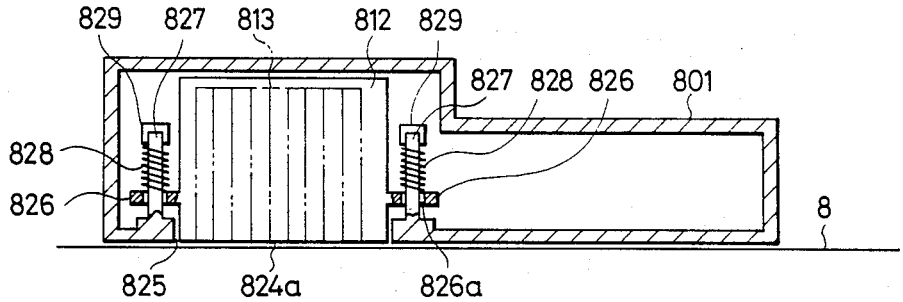

In accordance with the present embodiment, when the desk-top calculator 801 is lifted up, the printer unit 812 falls by its own weight and the force of coil spring 828 as shown in FIG. 36 and the step 824a projects downward. When the desk-top calculator 801 is placed on the sheet paper 8 disposed on the desk, the printer unit 812 ascends against the force of the coil spring 828 as shown in FIG. 37 and the step 824a is in contact with the sheet paper 8. Thus, the positive printing is attained.

Figure 38:
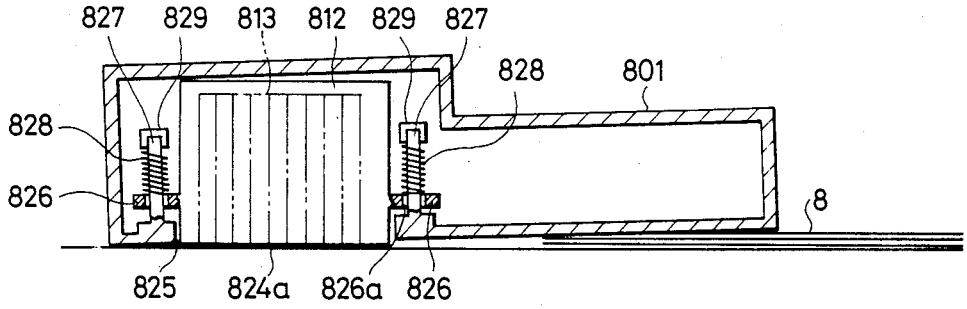

When the desk-top calculator 801 rises over a thick document or an projecting article on the desk, the print surface of the printer unit 812 moves independently of the bottom surface of the desk-top calculator 801 as shown in FIG. 38 and is urged toward the paper sheet 8. Accordingly, the printer unit 812 does not float and the printing is effected without non-uniform print or broken print.

In accordance with the present embodiment, since the printer unit is always urged toward the surface of the desk, the printer unit can always be in contact with the sheet paper, and when a portion of the electronic equipment rides over the projecting article on the desk, clear printing is attained without non-uniform print and broken print.

What I claim is:

1. Electronic equipment having a printer unit, comprising:

a housing having a bottom surface with an opening formed therein;

said print unit being displaceable within said housing toward and away from said opening of said housing;

a hollow type wheel having an outer periphery with a plurality of types mounted thereon;

a hammer means mounting said hammer for rotation within said type wheel, means actuating said hammer to project said types to effect printing, means enabling said print unit to selectively print on either a first print medium contained in said housing, or to print on a second print medium external of said housing including means to rotate said hammer between the locations of said first and second print mediums, means supporting said type wheel and said hammer in said print unit for displacement along with said print unit;

pressing means for pressing said print unit to displace said print unit bodily toward said opening so that a portion of said periphery of said type wheel is projectable outwardly from said opening; and said means to rotate said hammer including manual switching means for positioning said hammer, in the case of printing on said first print medium, to a first rotational position facing said first print medium, and in the case of printing on said second print medium, positioning said hammer to a second rotational position where said types of said type wheel are projectable through said opening, said manual switching means including an operation lever, a gear for transmitting rotation of said operation lever to said hammer and an engaging latch member connected to and actuated by said operation lever, said engaging latch member engaging said print unit when printing occurs on said first print medium to maintain said print unit at a position away from said opening against the pressing exerted by said pressing means, operation of said operation lever acting to release said engaging latch member from engagement with said print unit so that said print unit is displaced by said pressing means to a position adjacent said opening.

2. Electronic equipment having a printer unit according to claim 1, further comprising a cover member detachably mounted on said bottom surface of said housing to cover said bottom surface and having a recess at a position facing toward said opening in said bottom surface of said housing.

* * * * *

UNITED STATES PATENT AND TRADEMARK OFFICE

CERTIFICATE OF CORRECTION

PATENT NO. : 4,602,877

DATED : July 29, 1986

INVENTOR(S) : HIDEO FUSHIMOTO

It is certified that error appears in the above-identified patent and that said Letters Patent is hereby corrected as shown below:

COLUMN 1

Line 68, "roll" should read --roll,--.

COLUMN 3

Line 54, "paper," should read --paper--.
Line 55, "respectively." should read --respectively,--.

COLUMN 4

Line 62, "contacting to" should read --contacting--.
Line 68, "prjections" should read --projection.

COLUMN 6

Line 43, "clock-wise" should read --clockwise--.

COLUMN 8

Line 58, "of" (first occurrence) should read --on--.
Line 61, "effeciency" should read --efficiency--.

COLUMN 9

Line 2, "the the". should read --the elements the--.

COLUMN 10

Line 48, "fallen" should read --falls--.

UNITED STATES PATENT AND TRADEMARK OFFICE

CERTIFICATE OF CORRECTION

PATENT NO. : 4,602,877

DATED : July 29, 1986

INVENTOR(S) : HIDEO FUSHIMOTO

It is certified that error appears in the above-identified patent and that said Letters Patent is hereby corrected as shown below:

COLUMN 11

Line 7, "as to" should read --as--.

COLUMN 13

Line 21, "thiscondition" should read --this condition--.
Line 50, "as to" should read --as--.

COLUMN 14

Line 17, "like" should read --same--.
Line 50, "an" should read --a--.

Signed and Sealed this

Nineteenth Day of July, 1988

*Attest:*

*Attesting Officer*

DONALD J. QUIGG

*Commissioner of Patents and Trademarks*